US005343590A

United States Patent [19]

Radabaugh

[11] Patent Number: 5,343,590

[45] Date of Patent: Sep. 6, 1994

[54] LOW VOLTAGE CENTRAL VACUUM CONTROL HANDLE WITH AN AIR FLOW SENSOR

[75] Inventor: Kurtis R. Radabaugh, Ponca City, Okla.

[73] Assignee: Lindsay Manufacturing, Inc., Ponca City, Okla.

[21] Appl. No.: 833,984

[22] Filed: Feb. 11, 1992

[51] Int. Cl.[5] ..... A47L 5/38

[52] U.S. Cl. ..... 15/319; 15/339; 15/410

[58] Field of Search ..... 15/319, 339, 410

[56] References Cited

U.S. PATENT DOCUMENTS

| | | | |
|---|---|---|---|
| 1,055,985 | 3/1913 | Berger . | |
| 1,368,736 | 2/1921 | Lavigne . | |
| 1,806,871 | 5/1931 | Bower . | |
| 1,872,372 | 8/1932 | Winsley . | |
| 2,998,474 | 8/1961 | Pavlic . | |
| 3,283,226 | 11/1966 | Umpleby et al. . | |
| 3,300,571 | 1/1967 | Downey et al. . | |
| 3,314,039 | 4/1967 | Opper . | |
| 3,366,766 | 1/1968 | Umpleby . | |
| 3,382,524 | 5/1968 | Sandstrom . | |
| 3,536,836 | 10/1970 | Pfeiffer . | |
| 3,555,170 | 1/1971 | Petzetakis . | |
| 3,626,545 | 12/1971 | Sparrow . | |
| 3,749,947 | 7/1973 | Kawada et al. . | |
| 3,814,542 | 6/1974 | Iglesias et al. . | |
| 3,965,526 | 6/1976 | Doubleday . | |
| 4,225,272 | 9/1980 | Palmovist . | |
| 4,368,348 | 1/1983 | Eichelberger et al. . | |
| 4,382,543 | 5/1983 | Morrison . | |
| 4,399,585 | 8/1983 | Kullik et al. | 15/319 |
| 4,473,923 | 10/1984 | Neroni et al. . | |
| 4,490,575 | 12/1984 | Kutnijak . | |
| 4,494,270 | 1/1985 | Ritzau et al. . | |
| 4,654,924 | 4/1987 | Getz et al. | 15/410 X |
| 4,693,324 | 9/1987 | Choiniere et al. . | |
| 4,829,626 | 5/1989 | Harkonen et al. . | |
| 4,854,887 | 8/1989 | Blandin . | |
| 4,881,909 | 11/1989 | Blackman . | |
| 4,915,640 | 4/1990 | Hayden | 15/410 X |
| 5,023,973 | 6/1991 | Tsuchida et al. | 15/319 |
| 5,033,151 | 7/1991 | Krafft et al. | 15/319 |

FOREIGN PATENT DOCUMENTS

| | | | |
|---|---|---|---|
| 8104723 | 5/1982 | Netherlands | 15/339 |

*Primary Examiner*—Chris K. Moore
*Attorney, Agent, or Firm*—Stinson, Mag & Fizzell

[57] ABSTRACT

A remote control system for actuating a central vacuum system from a remote location such as a vacuum cleaning hose handle that includes an air flow sensor. In the preferred embodiment, a small, lightweight vacuum sensor and a sensor amplifier that is connected to an LED bar graph meter and a comparator circuit are installed in the remote control hose handle. A low voltage power signal is transmitted through the vacuum cleaner hose and to the remote control handle for the purpose of providing electrical current to power the central vacuum system. The vacuum sensor will enable the consumer to instantly know if the vacuum is producing enough air flow to get proper cleanability. The sensor will also notify the consumer if the vacuum cleaner has a full bag or a problem at the vacuum unit, such as a clogged screen. The low voltage control signal travels from the remote control handle through the power supply wires running the length of the vacuum hose, which are preferably covered by a sleeve, such as of cloth or plastic, then into the vacuum cleaning motor. An electrical relay located near or inside the central vacuum cleaning system receives the control signal from the hose wiring and processes it to start or stop a central vacuum system main motor.

13 Claims, 5 Drawing Sheets

LOW VOLTAGE CENTRAL VACUUM CONTROL HANDLE WITH AN AIR FLOW SENSOR

FIELD OF THE INVENTION

The present invention is directed to remote control of central vacuum systems. More particularly, the present invention is directed to an assembly using an electrical switch in a vacuum cleaner wand/hose end, that includes an air flow sensor, which transmits a signal to actuate a motor in the central vacuum system.

BACKGROUND OF THE INVENTION

Central vacuum systems are popular in a variety of buildings, notably family residences. A typical central vacuum system includes a vacuum pump connected to an electric motor for driving it, a plenum for generating a vacuum and duct work to another plenum for collecting debris in a vessel such as a bag and allowing exhaust air to be vented. The motor, vacuum pump and plenums are generally located in the basement or other relatively remote location within a house. A network of tubing or ducts connects the central vacuum cleaner to each of the rooms to be serviced. One or more vacuum hose connection points are located in each of the rooms to be serviced. These openings are generally covered by an air tight flap or valve to prevent the induction of air through unused openings and to maintain a vacuum within the system. A hose with a wand end is connected to one of the connection point openings when that room is to be vacuumed. The wand normally includes a handle for the user to hold and a suction head for drawing in the air and collected debris.

Difficulties with prior central vacuum systems lie with turning the central vacuum motor on and off, conveniently and reliably, determining whether the vacuum is in fact doing its job and producing enough air flow to get proper cleanability, or whether the bag or vessel for collecting debris is full. The distance from the location from the wand, or working point, to the central pump motor, generally prohibits a switch located on the vacuum motor. Because of the normal basement location of a central pump motor, climbing up and down stairs every time the user desires to use a system is inconvenient and tiring. As a result, several approaches to this problem of providing a convenient switch for operating the vacuum motor and for determining proper cleanability have been developed in the prior art.

One such attempted resolution involved mounting an electrical switch on the handle of the portable hose and routing two low voltage wires along the hose to a coupling ring on the end of the hose. When the hose is fastened to the wall opening outlet, as by use of a bayonet mount or screw mount, contact points on the coupling ring engage matching contact points on the fitting in the wall opening. The contact points on the wall opening fixture are connected to a light gauge wire pair that runs along a tubing to an electrical relay which switches the vacuum motor on and off. This system suffers from the serious disadvantages of not telling the operator how well the system is operating or giving the operator any kind of diagnostic tool that would indicate the proper system operation. The prior art only tells the operator whether the vacuum motor is operating or not operating.

An alternative approach to solving this problem is disclosed in U.S. Pat. No. 4,829,626, issued to Härkonen et al. on May 16, 1989. Härkonen discloses a method for controlling a vacuum cleaner that includes a battery operated electrical sound signal generator mounted in the handle of the wand. When the signal generator is activated, it generates and transmits a signal to the tubing, which in turn is sensed by an electrical relay which generates an electrical pulse to start the motor of the vacuum cleaner. In the Härkonen system, when an operating lever located in the handle is moved to the on position, a flap in the wand opens, allowing air to be drawn through the wand and the network of tubing to the vacuum cleaner and permitting the sound generated by the electrical signal generator to travel more easily to the electrical relay equipment located close to the vacuum cleaner motor. The sound signal is only generated momentarily in order to start the motor. Once the sound signal has been transmitted for the predetermined brief time, the sound generator is turned off. If the motor has started as intended, the motor keeps running until the flow of air through the system is blocked. It is intended that the flap and the hose near the wand be manually swung into a position across the inlet of the hose, thereby blocking the flow of air. Then a detector detects the stopping of the flow of air and in response, turns off the vacuum motor.

This proposed solution suffers also from several disadvantages. First, a chemical battery is required for operating a sound generator. The battery will necessarily run down and require replacement. More importantly, if the operator is not careful in the use of the machine, an old or run-down battery may leak corrosive chemicals into the sensitive and delicate sound generation equipment, ruining it. The battery and sound generator combination also occupy a significant volume within the handle of the wand, making the wand heavier, larger and more unwieldy.

Perhaps, the greatest difficulty with the method of Härkonen lies in the means for stopping the vacuum cleaner. In the normal course of using a vacuum cleaner, many possible events that could block the flow of air through the hose suggest Härkonen themselves. In some cases, merely pressing the vacuum head hard against a surface to be vacuumed can block the flow of air sufficiently to cause the vacuum motor to stop. This is particularly the case when the vacuum head is operated near or on non-porous materials. Further, items too large to pass conveniently through the tubing may be inadvertently sucked into the vacuum head, thereby turning it off.

Accordingly, there is a need for a remote control switching system for central vacuum systems that can reliably be turned on from the wand and that can provide instant indication of the cleanability of the vacuum cleaner system. Additionally, there is a need for a central vacuum system that includes a monitoring function to evaluate unit performance and signal when the vessel for collecting debris such as a bag is full or there is a clogged screen.

SUMMARY OF THE INVENTION

In the preferred embodiment, the instant invention includes a mechanism control signal which utilizes low voltage that is supplied through a standard 15–30 volt AC or DC low voltage wiring that runs the length of the vacuum cleaner hose and which is used to power the remote control handle with an air flow sensor. The low voltage electrical power is provided along the length of the vacuum hose by a pair of wires enclosed in a helical hose convolution and has an electrical plug-in plugged into the central vacuum wall value pin jacks or slip rings. The control signal travels through the hose wiring to an electrical relay located by the central vacuum system pump motor to activate the pump motor and cause operation and deactivation of the system.

The vacuum cleaning system also includes an air flow sensor which signals when vacuum pressure falls below a predetermined level, indicating whether the vacuum is, in fact, doing its job. The air flow sensor provides indication of the vacuum cleaning system cleanability and also provides an indication of a problem with the vacuum system, such as a clogged screen, a full bag or insufficient air watts to power an air turbine attachment, so that the condition may be corrected by the user.

OBJECTS OF THE INVENTION

Accordingly, it is the primary object of the present invention to provide a remote control switching mechanism for central vacuum systems that allows the central vacuum pump motor to be turned on from the wand.

It is a further object of the present invention to provide a means for monitoring the vacuum pressure flow and air watts of a vacuum cleaning system to signal partial or complete obstruction to air flow or a leak in the system.

It is a further object of the present invention to provide a remote control switching arrangement having the means for converting a vacuum to voltage signal in response to the remote control switch signal.

It is further the object of the present invention to provide a remote control switching mechanism for central vacuum systems having the means for amplifying the converter vacuum to voltage signal and displaying the amplified voltage signal.

It is a further object of the present invention to provide an intrinsically safe system by virtue of low voltage and eliminating the need for agency approvals and reducing the manufacturing costs.

It is a further object of the present invention to provide a remote control switching mechanism for central vacuum systems, having the means for comparing said amplified voltage signals to preselected control signals, thereby providing an indication of the potential cleanability of the central vacuum system.

It is a further object of the present invention to streamline the aesthetic and functional aspects by providing an optional attractive non-convoluted sleeve covering the vacuum hose and insulated electrical conductors, thus protecting the conductors, the hose, the consumer's furniture and woodwork. The unique ergonomically designed handle incorporates electrical inlet and outlet switches for on and off functions and an air flow sensor. The air flow sensor includes an amplifier used to amplify the sensor signals and is connected to a voltage comparator circuit that checks the air flow to see if it is within a specified range. The handle includes indicator lamps and an LED bar graph display to indicate the air flow and any cleanability problem, thereby indicating whether service is required.

It is a further object of the present invention to provide a means for a diagnostic determination of proper system operation.

DETAILED DESCRIPTION OF THE PREFERRED AND ULTIMATE EMBODIMENTS

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
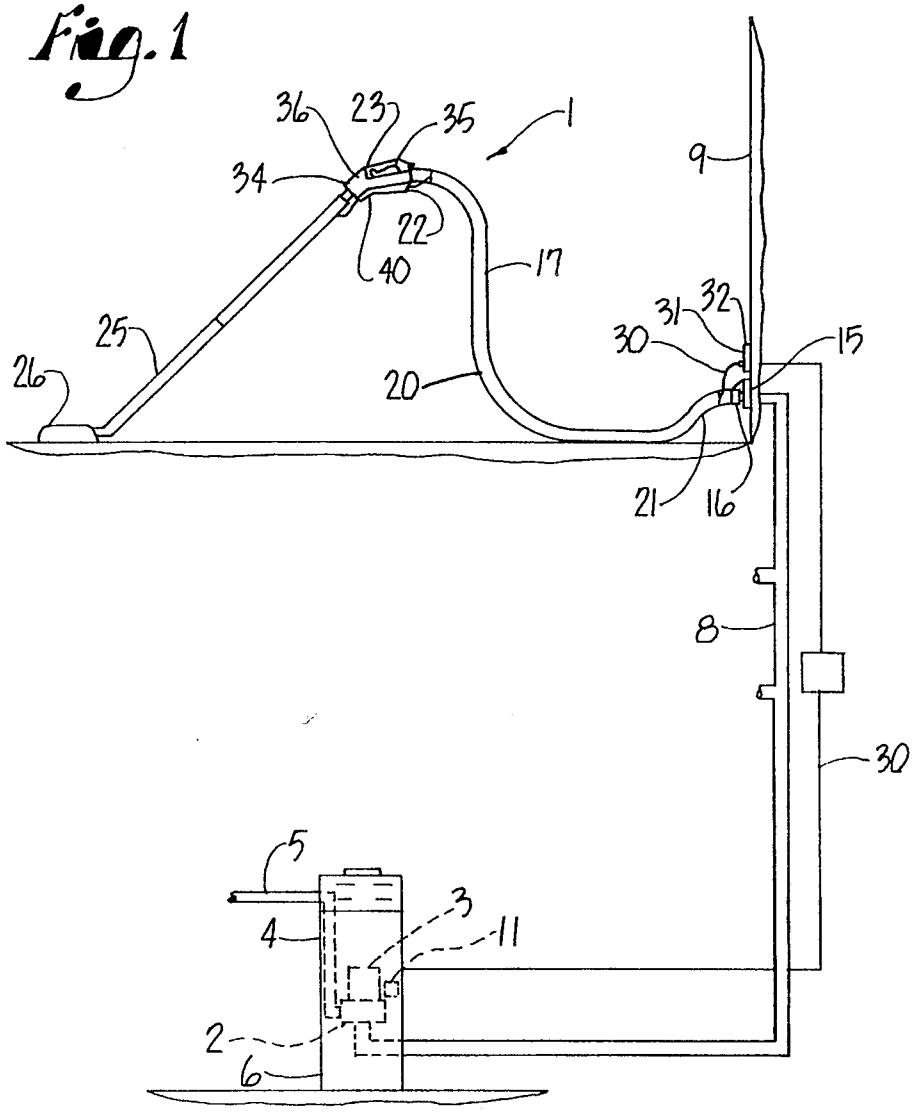
FIG. 1 is a plan view of a central vacuum cleaning system embodying the present invention.

Referring to FIG. 1, there is shown a central vacuum cleaning system 1, including a vacuum pump 2 connected to an electric motor 3 for driving it, a plenum 4 for generating a vacuum and duct work 5 to another plenum 6 for collecting debris in a vessel such as a bag or a cyclonic collection chamber and allowing exhaust air to be vented. The motor 3, vacuum pump 2 and plenums 4 and 6 are generally located in the basement or other relatively remote location within a house. A network of tubing or ducts 8 connects the central vacuum cleaner to each of the rooms 9 to be serviced. One or more vacuum hose connection points 15 are located in each of the rooms 9 to be serviced. These openings are generally covered by an airtight flap or valve 16 to prevent the induction of air through unused openings and to maintain a vacuum within the system. A hose with the wand end is connected to one of the connection point openings when that room is to be vacuumed.

In the example shown in FIG. 1, a vacuum hose 20 has one end 21 inserted into the connection point 15 and a distal end 22 to a hose handle 23. A wand 25 is connected to the hose handle 23 and a cleaning implement fitted to the end of the wand 25. In the illustrated embodiment, an air driven cleaning appliance 26 is connected to the end of the wand 25, wherein the cleaning appliance 26 may be a carpet sweeper brush or an upholstery brush or above floor tools. To route electrical power to the hose handle 23, a power line 30 is combined with the vacuum hose 20 as hereinafter described and includes one end 31 plugged into a wall socket 32 carrying low voltage electrical current, which is a standard 15–30 volt AC or DC current, normally operating at 24 volt AC. The power line 30 is routed through the hose handle 23 to a connection 24 at the end of the hose handle 23.

The present invention is directed to a remote control device 34, such as located within the hose handle 23, that is remotely positioned from the central vacuum cleaner pump motor 3 and is used to generate an electrical signal which is applied to wiring within the low voltage power line 30. The electrical signal is a control signal and is transmitted throughout the house on the low voltage wiring. An electrical relay 11 is generally proximately positioned near the central vacuum cleaning pump motor 3, such as within or without the motor pump housing and is also connected to the low voltage wiring. The relay detects the control signal applied to the low voltage power line 30 by the remote control device 34 and turns on and off the vacuum motor 3 in response to the received control signals.

Figure 2:
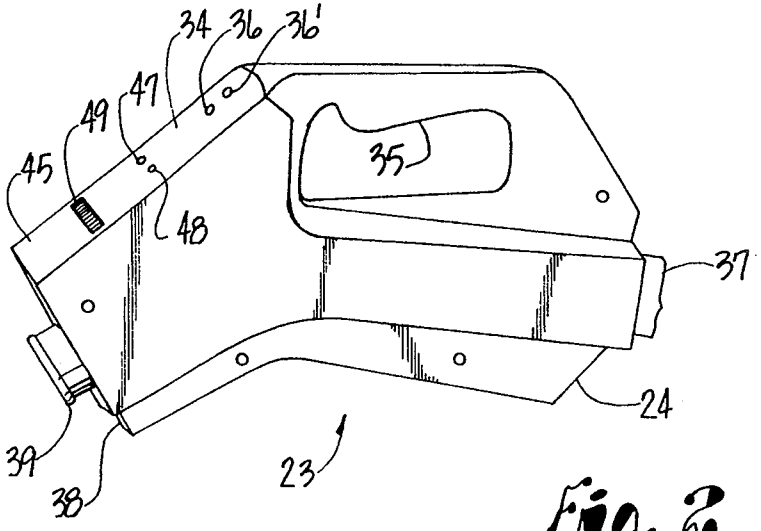
FIG. 2 is an elevational view of a remote handle for a central vacuum cleaning system, including an air flow sensor assembly.
Figure 3:
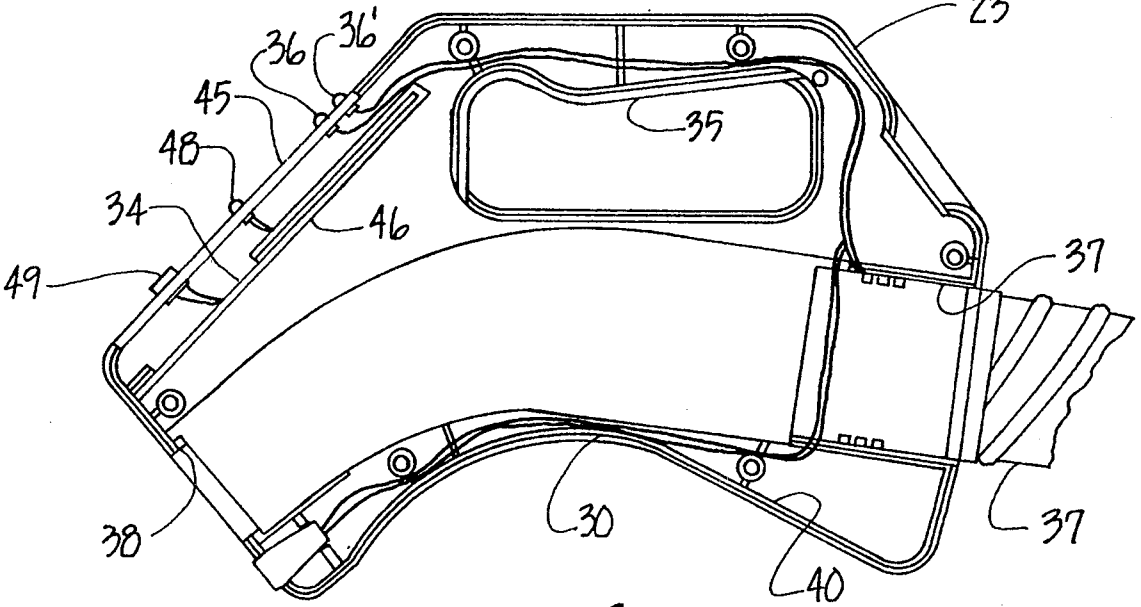
FIG. 3 is a longitudinal sectional view of the handle.

In the illustrated example, FIGS. 1 and 2, a remote control device 34 is mounted within the hose handle 23, although it will be appreciated that the remote control device may be located in virtually any convenient place. The hose handle 23, as illustrated in FIGS. 1, 2 and 3, includes a handhold 35, on-off switches 36 and 36' for operation of the power supply and low voltage return load 54, FIG. 4, inlet and outlet openings 38 and 37 for a vacuum tube 39 and a vacuum or air flow sensor 55, FIG. 3. The low voltage power line 30 runs in a bottom channel 40, along the handle 23. A front facia section 45 conceals a circuit board 46 containing the power supply and low voltage return load 54, FIG. 4. The facia section 45, as best shown in FIG. 2, includes indicator lights, such as LEDs 47 and 48, and a LED bar graph display 49. The LEDs 47 and 48 protrude through the facia section 45 to indicate operation of the vacuum cleaner system 1. In particular, the LED 48 is preferably amber in color and indicates the system is not providing the proper air flow for proper cleanability while using the air driven cleaning appliance 26. The amber indicator light LED 48 also indicates a problem with the central vacuum system such as a full bag, a vacuum leak, a clogged line, thereby indicating service is required when using an air-driven appliance. If the LED 47, which is preferably red in color illuminates during operation of the system, or after the start button 36 is depressed, it then indicates a full bag, vacuum leak, or a clogged line, thereby also indicating service is required. The LED bar graph display 49 indicates that the system is on and provides further indication of the vacuuming pressure, air flow and air watts and of the potential cleanability of the central vacuum system. Manually operable on and off switches 36 and 36' protrude through the facia section 45.

Figure 4:
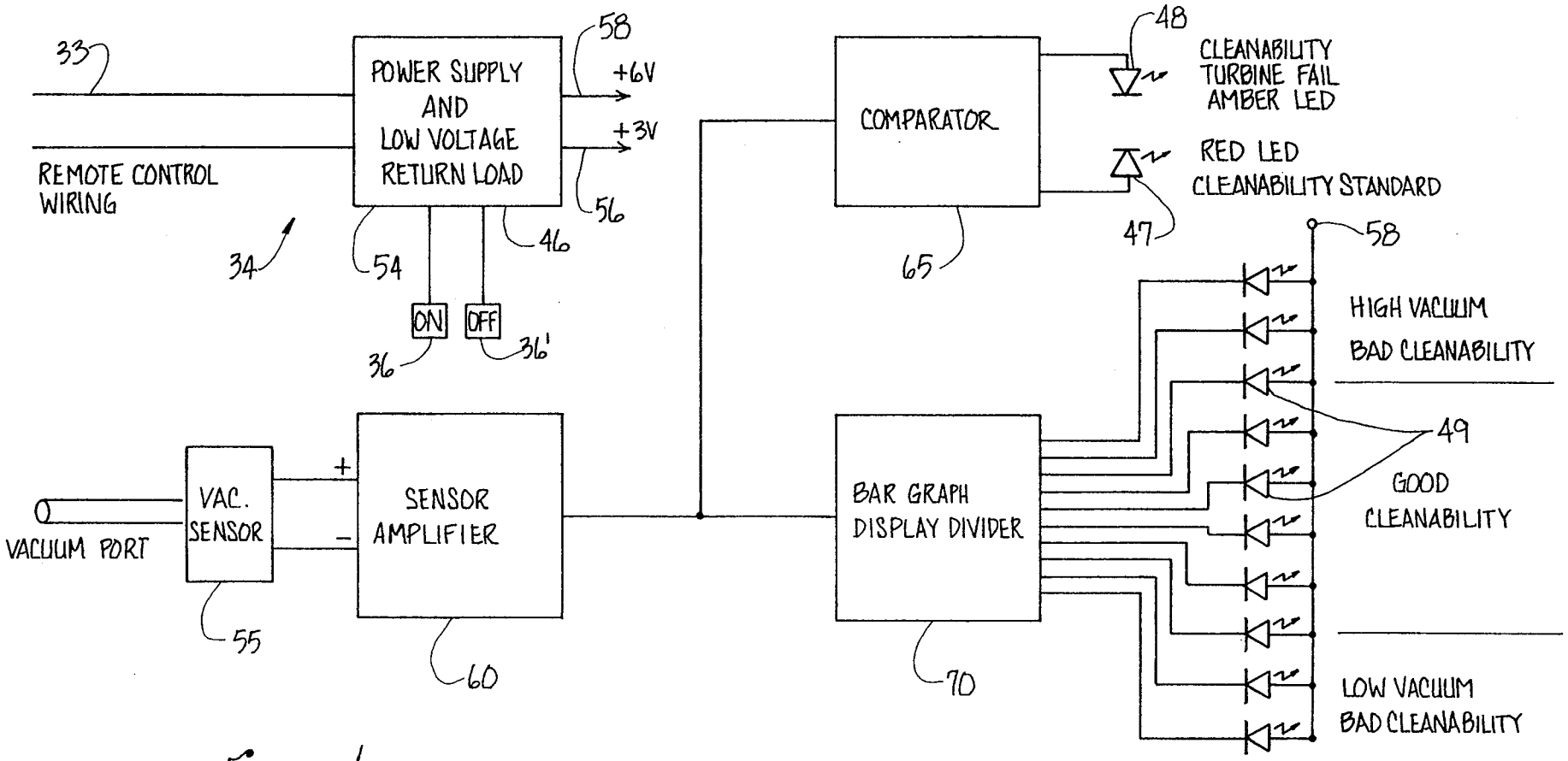
FIG. 4 is a block diagram of the air flow sensor assembly.

Turning to FIG. 4, the remote control device 34 is shown diagrammatically and includes the vacuum on and off switches 36 and 36' which protrude through facia section 45. Power to the switches 36 and 36' is provided through the remote control wiring 33 which is connected to the low voltage power supply line 30 and connected to the power supply and low voltage return load 54. The power supply and low voltage return load 54 will either convert 15–30 volt AC to 15–30 volt DC or it will automatically select a proper polarity so that positive and negative polarity is correct regardless of whether AC or DC power is supplied. The power supply 54 will further filter the converted DC voltage to provide a proper and interference-free DC waveform. The power supply 54 will additionally produce a three volt, highly precisioned regulated supply 56 which is electrically transmitted through the remote control wiring 33 to the vacuum sensor 55 and to the comparator 65. The power supply also produces a six volt unregulated current supply 58 that is electrically transmitted through the remote control wiring 33 to the sensor amplifier 60, the comparator 65 and the LED bar graph display 49.

Figure 5:
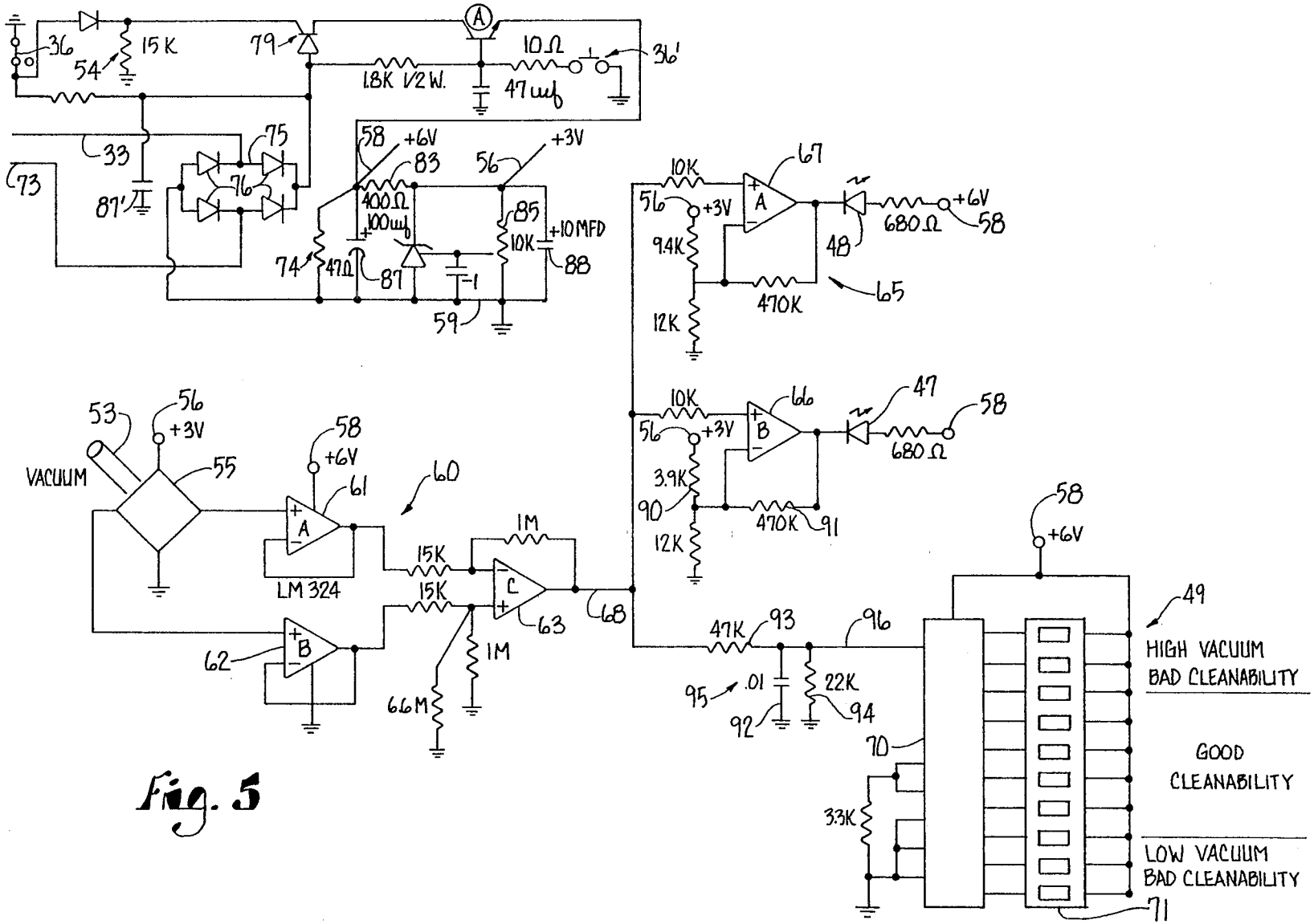
FIG. 5 is an electrical schematic diagram of the air flow sensor assembly.

Referring to FIG. 5, the preferred embodiment of the remote control device 34 is shown schematically. When the start push button vacuum on switch 36 is pressed, a signal is sent to an SCR 79. The SCR 79 will then short, causing current to flow through transistor A, FIG. 5, causing a voltage drop across a 47 ohm resistor 74. The off switch 36' when pushed causes the transistor A to turn off and the SCR to open causing no current through the bridge rectifier. This creates a current through a bridge rectifier 75 which includes four diodes 76 that either convert the 24 volt AC to DC or they will automatically select a proper polarity of the current coming out of the bridge rectifier 75. A capacitor filter 87 and 87' rated at least 45 volts is electrically connected immediately after the bridge rectifier 75 and filters out any AC current ripple or noise producing a good DC clean power supply. The DC current then flows to a 400 ohm resistor 83 that is a current limiting resistor for the variable zener diode TL431 84. The zener diode 84 produces a three volt, highly precision regulated supply 59. The zener diode 84 then delivers this three volt regulated supply 59 to a 10K resistor 85 which is further filtered through a 10 microfarad filter 88 producing the three volt highly precisioned power supply 56. There is also a six volt unregulated supply 58 produced at the 100 microfarad filter 87 that is electrically connected and supplies voltage power to the amplifier 60, the comparator 65 and the bar graph display 49. The six volt unregulated current supply 58 has a possible range from three volt to eighteen volts. The three volt precision supply 56 is electrically connected to the vacuum air flow sensor 55 and the comparator 65.

The air flow sensor 55 is an integrated circuit microchip manufactured by Motorola designated MPX10GVP. The vacuum sensor 55 is a differential gauge vacuum sensor that includes a vacuum orifice or port 53. The vacuum sensor 55 is able to sense a vacuum from 0 to −1.5 pounds per square inch. The vacuum sensor 55 is electrically connected to the sensor amplifier 60.

The amplifier 60 includes two buffer amplifiers 61 and 62 and a differential gain amplifier 63. The vacuum air flow sensor 55 converts the vacuum to a cubic feet per minute rating that is converted to a differential voltage and is electrically transmitted to the buffer amplifiers 61 and 62. The buffer amplifiers 61 and 62 make up microchip LM324 that buffs the incoming signal providing a one to one buffer amplification. The buffer amplifiers 61 and 62 are then electrically connected to the differential amplifier 63 that has an adjustable gain from 0 to 1500, but in the preferred embodiment has an approximate gain of 66. The signal coming out of the differential gain amplifier 63 will equate to an air flow value between 0 and −1.5 pounds per square inch depending upon how much air flow is sensed at the air flow sensor 55 and the amplifier 60. The amplified signal 68, which has a zero to three voltage signal, is electrically connected to the comparator and the LED bar graph display 49.

The comparator circuit 65 compares the incoming zero to three voltage signal 68 from the air flow sensor 55 and the sensor amplifier 60 to preselected values. The comparator includes two circuits 66 and 67 that are electrically connected to indicator lights 47 and 48. The comparator circuit 66 is preset at six inches of water vacuum so that when the vacuum signal from the vacuum sensor 55 through the amplifier 60 is less than 6 inches of water, the red indicator light 47 comes on. A vacuum signal above seven inches of water will make the low vacuum comparator circuit 66 turn off the red indicator light 47. The comparator circuit 67 is a high vacuum comparator circuit and is preset at 28 inches of water vacuum. When the vacuum from the vacuum sensor 55 through the amplifier 60 is below 28 inches of water, the comparator circuit 67 turns on the amber indicator light 48. Any vacuum signal above 28 inches of water will make the comparator circuit 67 turn off the amber indicator light 48. The purpose of the amber indicator light 48 is to monitor the air flow when using the air driven cleaning appliance 26. Generally, 30 inches of water or above of vacuum that is sent to the air driven cleaning appliance through the wand 25 will allow efficient operation of the cleaning appliance and of the vacuum cleaning system 1.

Therefore, if the user of the vacuum cleaning system 1 develops a problem with the plenum for collecting debris 6 or the bag such that the unit is getting full, and reducing vacuum, reducing the air flow, the vacuum at the handle 23 would drop which can lead to poor operation of the air driven cleaning appliance 26. If the amplified vacuum signal 68 drops below 28 inches of water, which can indicate poor operation for the air driven cleaning appliance 26, the amber indicator light 48 will illuminate, indicating to the user that a full bag or a leak in the system is causing the air driven cleaning appliance 26 to operate improperly. If the user of the vacuum cleaning system 1, however, is using a non-air driven cleaning floor appliance, then the user should only be concerned with the red indicator light 47. This is because the amber indicator light 48 only provides an indication that the air driven cleaning appliance 26 may not have enough air flow to operate properly. Therefore, if the air driven cleaning appliance 26 is not being used, then the amber indicator light 48 can be ignored. The red indicator light 47, however, will still indicate to the user, when using the regular cleaning floor appliance 27, that there is either a leak in the system or that the bag is full.

The low vacuum comparator circuit 66 is connected to the precision three volt supply 56 through two resistors 90 and 91 which allows a certain voltage to be selected to equate to a certain vacuum level. In the preferred embodiment, a voltage of two from the precision three volt supply 56 is approximately equal to six inches of vacuum. This value is compared to the amplified signal 68 and if the amplified signal 68 is below the reference two volt supply, the comparator 65 will be energized and turn the red indicator light 47 on. As long as the amplified vacuum signal 68 is equal or greater than the preset two volt supply, the comparator 65 will not be energized and the red indicator 47 will be off. The two resistors 90 and 91 simply act as a control function or feedback to keep the comparator 65 from oscillating and thereby provide an accurate comparison. Likewise, the high vacuum comparator circuit 67 also is electrically connected and supplied by the precision three volt supply 56 and also has a preset value set to equate to 28 inches of vacuum. Therefore, if the incoming amplified vacuum signal 68 is greater than the preset value, then the comparator circuit 67 is not energized and the amber indicator light 48 is off.

The amplified vacuum signal 68 is also an input signal to the LED bar graph display 49. Immediately after the differential gain amplifier 63, but before the LED bar graph display 49, is a voltage divider network 95. The voltage divider network 95 includes a 47K resistor 93, a 22K resistor 94 and a 0.01 microfarad capacitor 92. The 47K resistor 93 and the 22 K resistor 94 ensure that the amplified vacuum signal 68, that has a maximum three voltage value, is reduced to a maximum 1.25 volts. The 1.25 volts is the maximum input voltage that the LED bar graph display 49 will accept. The 0.01 microfarad capacitor 92 filters any undesirable noise or any quick shifting impulses from the amplified vacuum signal 68, thereby providing a 1.25 voltage signal 96 to the LED bar graph display 49. The LED bar graph display 49 includes a bar graph display driver 70 and the LED bar display 71. The bar graph display driver 70 is an integrated circuit microchip manufactured by National Semiconductor and designated LM3914N. The graph display driver to LM3914N chip basically is a line of ten comparators, similar to the comparators 66 and 67, that compare an unknown voltage against a known, reference voltage. In the preferred embodiment, the maximum voltage of 1.2 volts DC 96 to the bar graph display driver 70 energizes and lights the highest LED indicator on the bar graph display 71. A zero volt DC input to the bar graph display driver 70 will energize the lowest or bottom indicator to the bar graph display 71. The maximum voltage of 1.25 volts DC would equate to a very high vacuum, indicating to the user of the vacuum cleaning system 1 that the vacuum wand 25 or the air driven cleaning appliance 26 is plugged. The low indicator lights to the LED bar display 71 indicate to the user of the cleaning system 1 that the plenum for collecting debris 6 or the bag is full or that there is a leak in the vacuum cleaning system 1 behind or after the wand 25. The midrange indicator lights to the LED bar display 71 indicate to the user of the vacuum cleaning system 1 that there is proper vacuum or air flow thereby providing good cleanability.

Figure 6:
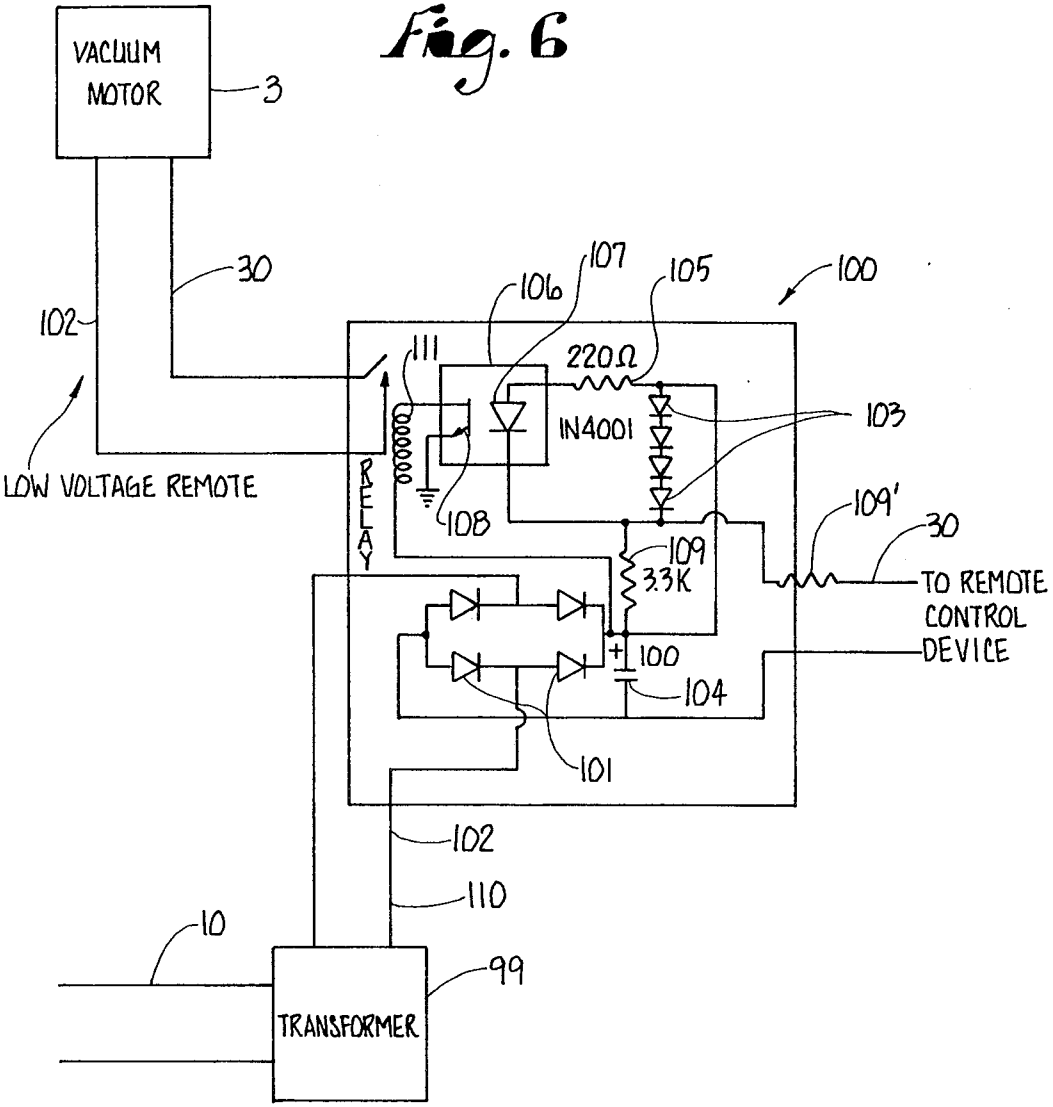
FIG. 6 is an electrical schematic diagram of a converter booster for the air flow sensor assembly.

Referring to FIG. 6, a booster adaptor 100 is schematically illustrated which allows the remote control device 34 to use a non-standard 12 or 10 volt low voltage power supply. The remote control power device 34 is designed to use a standard 24 volt AC output from the electric vacuum motor 3 through the low voltage power line 30. If for some reason a different voltage output is used, this booster adaptor 100 allows the remote control device 34 to use the different voltage supply. Further, if a vacuum system includes an excessive amount of power line 30, for example, over 300 feet in length, then the booster adaptor 100 may also be required. Individuals with very large houses having central vacuum cleaning systems 1 that have low voltage power lines 30 that are over 300 feet in length, may need to use the booster adaptor 100. The booster 100 would be located and connected near the electric motor 3 and would also be electrically connected to a transformer 99 through low voltage power line 102. The transformer 99 would be connected to a household current electrical supply that is a 110–125 volt AC current at 60 Hertz 10. A transformer 99 converts the 110 volts to 16 volts AC 110. The 16 volts AC 110 is electrically transmitted to the booster adaptor 100 through the low voltage power line 102. The booster adaptor 100 includes a bridge rectifier 101, four IN4001 diodes in series 103, a 100 microfarad capacitor 104, a 220 ohm resistor half-watt 105, an optical coupler 106, an LED indicator 107, a photo transistor 108, a 3.3K resistor 109, a 33Ω 2 watt safety resistor 109' and electrical connections to the remote control device 34 and the vacuum motor 3 through low voltage power lines 30. The 16 volt AC current 110 is electrically transmitted to the bridge rectifier 101 that converts the 16 volts AC to 16 volts DC which is then connected to the four IN4001 diodes in series 103. The diodes in series 103 prevents current from flowing to the return power line until the switch 36 at the handhold 35 is turned on. With the switch 36 turned on, the DC current from the bridge rectifier 101 will then flow to the four IN4001 diodes in series 103 and develop a voltage drop across the four IN4001 diodes in series 103. The voltage drop will be current limited to the 220 ohm resistor 105 and into the optical coupler 106 which will turn on the LED indicator 107 in the optical coupler 106. The optical coupler 106 further has a transistor 108 that will short a relay 111 and in turn will short the vacuum low voltage relay, turning on the motor. The 3.3K resistor 109 will secure power to the optical coupler 106 when there is no load applied to the low voltage power line 30. The effect of the booster adaptor 100 is to provide enough voltage and current to operate the remote control device 34. Without the booster adaptor 100, a vacuum motor which provides only twelve or six volts would not have enough current to run the handle and engage the vacuum motor relay switch at the same time.

In operational terms then, the central vacuum cleaning system 1 includes a central vacuum cleaning pump motor 3 and a vacuum hose 20 with a power supply line 30 for connection to vacuum pump motor 3. The vacuum cleaning system 1 includes a remote control device 34 which transmits a control signal over the low voltage power line 30. The vacuum cleaning system 1 includes a control signal switch 36 that actuates the central vacuum pump motor 3 in response to receipt of the control signal. In FIG. 1, a vacuum cleaning hose 20 which is particularly useful in conjunction with the present invention, includes an elongate hose 20 having its end 21 for connecting to a vacuum cleaner plenum 6 via the valve 16 and a network of tubing or ducts 8 and a distal end 22, for connection to a cleaning appliance 26, such as an air driven carpet sweeper. The low voltage power line 30 extends along the hose 20, such as parallel thereto and connects the hose 20. A sleeve 17 fits snugly extended over the hose 20 and the power line 30 and binds the power supply line to the hose. The optional sleeve 17 may be a heat shrinkable plastic which is pulled in its unshrunk condition tightly over the combined end hose and then heat is applied to the shrinkable sleeve so that it contracts tightly about the hose and power line to form a unitary structure. A second means of applying a sleeve tightly about the hose 20 and power line 30 is to co-extrude a plastic sleeve from an extruder about the hose and power line 30. A third method is to install a circular knitted sleeve.

The remote control device 34 allows a consumer who is using the remote device 34 on his or her carpet to be able to instantly tell if the central vacuum system 1 is performing adequately. The remote control device 34 includes a vacuum air flow sensor 55, an LED bar graph display 49 and a comparator 65. The vacuum air flow sensor 55 converts the vacuum air flow to a voltage signal and is transmitted to a sensor amplifier 60 which amplifies the sensor signals and transmits the sensor signals to the comparator 65 and the LED bar graph display 49. The comparator 65 compares the amplified vacuum air flow signals to predetermined signals and provides the consumer with an instant indication of the operation of the vacuum cleaning system 1. If the vacuum cleaning system 1 is producing sufficient air flow for proper cleanability, the LED bar graph display 49 will be illuminated in the midrange section of the display 49, thereby indicating this condition. If the vacuum cleaning system 1 has a full bag or a leak or a problem at the vacuum unit 2, then a low reading at the LED bar graph display 49 and a comparator red indicator light 47 will be energized and presented. If the consumer is using the air driven cleaning appliance 26 and the cleaning appliance 26 or the wand 25 is plugged, the LED bar graph display 49 will indicate a high vacuum and poor cleanability for the vacuum cleaning system 1. Further, the vacuum cleaning system 1 at the handhold 35 further includes an LED indicator amber light 48 to indicate to the consumer that when he is using the air driven cleaning appliance 26 and there is insufficient air flow to operate the cleaning appliance, the amber light 48 will illuminate. Therefore, the low voltage central vacuum control handle 23 with the air flow sensor 55 as in the preferred embodiment, gives the consumer the complete proper system operation of the vacuum cleaning system 1.

It is to be understood that while certain forms of this invention have been illustrated and described, it is not limited thereto, except insofar as such limitations are included in the following claims.

What is claimed and desired to be secured by Letters Patent is as follows:

1. A control handle for a central vacuum cleaning system comprising:

a) a body having a hand hold for grasping;

b) said body having outlet and inlet air connection means;

c) electrical transmission lines having means for connecting said body to said vacuum system for operation of said handle and said vacuum system;

d) an air flow passage through said body interconnecting said outlet and inlet air connection means;

e) an air flow sensor mounted in said body having means for sensing an air flow characteristic in said air flow passage, said air flow characteristic being the magnitude of the pressure of the air flow;

f) a converter having means for converting the magnitude of said sensed air flow pressure to a voltage signal;

g) a voltage amplifier having means for amplifying said voltage signal; and h) a voltage comparator having means for comparing said amplified voltage signal to preselected control signals, and means for transmitting a signal to an indicator mounted in said body having means for indicating whether sufficient vacuum air flow pressure is present for proper operation of said vacuum system.

2. A low voltage central vacuum control handle for a central vacuum cleaning system comprising:

a) a remote handle for grasping having an air flow passage through said remote handle, said remote handle attached to an end of a vacuum cleaner hose of said vacuum system, said remote handle also having a manually operable switch having means for controlling the energization of said vacuum system;

b) means for connecting an electrical transmission line extending along said vacuum cleaner hose to said remote handle for operation of said remote handle and said vacuum system;

c) said remote handle having:

i) an air flow sensor mounted in said remote handle and including means for sensing an air flow characteristic in said air flow passage, said air flow characteristic being the magnitude of the dynamic pressure of the air flow;

ii) means for converting the magnitude of said sensed air flow pressure to a voltage signal in response to said switch energizing said vacuum system;

iii) means for transmitting said voltage signal along said electrical transmission line;

iv) means for amplifying said voltage signal;

v) means for comparing said amplified voltage signal to preselected control signals; and vi) means for indicating to a user using the comparison of said amplified voltage signal to said preselected control signal to provide an indication of the state of the operation of said vacuum system.

3. In a central vacuum cleaning system, including a central vacuum cleaning pump motor and one or more remote operating locations and having a transportable vacuum cleaning hose with a low voltage power supply line attached to said hose, the improvement comprising a remote handle attached to an end of said hose, said handle comprising:

a) an air flow passage through said remote handle;

b) an air flow sensor having means for sensing an air flow characteristic in said air flow passage and said hose, said air flow characteristic being the magnitude of the dynamic pressure of the air flow;

c) means for connecting said low voltage power supply line to said remote handle;

d) a manually operable switch having means for controlling the energization of said vacuum system;

e) means for converting the magnitude of said sensed air flow pressure to a voltage signal in response to said switch energizing said vacuum system;

f) means for transmitting said voltage signal and operation of said switch along said low voltage power supply line;

g) means for amplifying said voltage signal;

h) means for comparing said amplified voltage signal to preselected vacuum air flow voltage signal values; and i) means using the comparison of said amplified voltage signal to said preselected control to provide an indication of the state of the operation of said vacuum system.

4. A low voltage central vacuum control handle for a central vacuum cleaning system comprising:

a) a remote handle for grasping having an air flow passage through said remote handle, said remote handle attached to an end of a vacuum cleaner hose of said vacuum system;

b) means for connecting a low voltage power supply line of said vacuum cleaner hose to said remote handle;

c) an air flow sensor mounted in said remote handle having means for sensing an air flow characteristic in said air flow passage and converting said sensed air flow characteristic to a voltage signal, and means for amplifying said voltage signal through a voltage amplifier, said air flow characteristic being the magnitude of the dynamic pressure of the air flow;

d) said amplifier having electrical connection means with an LED bar graph display and a voltage comparator circuit;

e) said voltage comparator mounted in said remote handle having electrical connection means with light emitting diodes and having means for comparing said amplified voltage signal to preselected control signals;

f) said LED bar graph display and said light emitting diodes mounted in said remote handle and having means using the comparison of said amplified voltage signal to said preselected control signal to provide an indication of the state of the operation of said vacuum system; and g) said remote handle having means for actuating said vacuum cleaning system.

5. The low voltage central vacuum control handle set forth in claim 4 wherein said low voltage power supply line has electrical connection means with said air flow sensor.

6. The low voltage central vacuum control handle set forth in claim 4 wherein said LED bar graph display has means for comparing said amplified voltage signal to preselected vacuum air flow voltage signal values and said amplifier has electrical connection means for transmitting said amplified voltage signal to said LED bar graph display comparing means and said voltage comparator circuit.

7. A remote control arrangement for actuating a central vacuum cleaning system comprising:

a) a vacuum cleaner hose associated with a low voltage power supply line attached to said hose;

b) a wand handle located at a distal end of said hose, said handle having a manually operable switch having means for controlling the energization of said vacuum system, and an air flow passage through said handle;

c) an air flow sensor mounted in said handle having means for sensing an air flow characteristic in said air flow passage and said hose, said air flow characteristic being the magnitude of the dynamic pressure of the air flow; and d) said handle having:

i) means for converting the magnitude of said sensed air flow pressure to a voltage signal in response to said switch energizing said vacuum system;

ii) means for transmitting said voltage signal and operation of said switch along said low voltage power supply line;

iii) means for amplifying said voltage signal;

iv) means for indicating to a user whether sufficient vacuum air flow pressure is present for proper operation of said vacuum system; and v) means for comparing said amplified voltage signal to preselected control signals and transmitting a compared signal to said indicating means for indicating said operation of said vacuum system.

8. A low voltage central vacuum control handle for a central vacuum cleaning system comprising:

a) a remote handle for grasping having an air flow passage through said remote handle, said remote handle attached to an end of a vacuum cleaner hose of said vacuum system, said remote handle also having a manually operable switch having means for controlling the energization of said vacuum system;

b) means for connecting an electrical transmission line extending along said vacuum cleaner hose for operation of said handle and said vacuum system, said electrical transmission line having a low voltage power supply line;

c) an air flow sensor mounted in said remote handle and including means for sensing an air flow characteristic in said air flow passage and said vacuum cleaner hose, said air flow characteristic being the magnitude of the dynamic pressure of the air flow;

d) said remote handle having:

i) means for converting the magnitude of said sensed air flow pressure to a voltage signal in response to said switch energizing said vacuum system and means for transmitting said voltage signal along said electrical transmission line;

ii) means for amplifying said voltage signal;

iii) means using the comparison of said amplified voltage signal to said preselected control signal to provide an indication of the state of the operation of said vacuum system; and iv) means for comparing said amplified voltage signal to preselected control signals and transmitting a compared signals to said indicating means for indicating said operation of said vacuum system; and e) a converter electrically connected to said remote handle through said electrical transmission line, said converter having means for providing a boost in said low voltage power from said electrical transmission line when said lower voltage power is below desired signal to electrically power said remote handle and said vacuum system.

9. The low voltage central vacuum control handle as set forth in claim 2, wherein said remote handle has outlet and inlet air connection means, said outlet air connection means connected to said vacuum cleaner hose and said inlet air hose connection means connected to a first end of a wand, said wand having a second end with means for selectively connecting an air driven vacuum tool to said second end.

10. The low voltage central vacuum control handle as set forth in claim 9, wherein said wand has means for selectively connecting a non-air driven vacuum tool to said second end of said wand, and said remote handle has electrical connection means with said non-air driven vacuum tool.

11. The low voltage central vacuum control handle as set forth in claim 8, wherein said means providing an indication of the state of operation of said vacuum system includes means for indicating to said user when the magnitude of said air flow pressure in said air passage is below a preselected air flow pressure setting.

12. The low voltage central vacuum control handle as set forth in claim 8, wherein said means providing an indication of the state of the operation of said vacuum system includes means for indicating when said vacuum cleaner hose has insufficient air flow pressure to operate an air driven vacuum tool and that said vacuum system is not providing sufficient vacuum air flow pressure for cleaning purposes.

13. The low voltage central vacuum control handle as set forth in claim 8, wherein said means providing an indication of the state of the operation of said vacuum system includes means for indicating when said vacuum cleaner hose is obstructed.

* * * * *